United States Patent [19]

Jones

[11] 4,197,447

[45] Apr. 8, 1980

[54] MODULAR INFRARED SPACE HEATER DEVICE

[76] Inventor: John P. Jones, Green City, Mo. 63545

[21] Appl. No.: 797,257

[22] Filed: May 16, 1977

[51] Int. Cl.[2] ..... H05B 1/00; F24H 3/02

[52] U.S. Cl. ..... 219/365; 126/110 R; 219/342; 219/367; 219/368; 219/370; 219/377

[58] Field of Search ..... 219/365–371, 219/374, 375, 376, 377, 378, 342, 343, 347, 354; 126/101, 110 R, 270, 271; 237/16–18

[56] References Cited

U.S. PATENT DOCUMENTS

| | | | |
|---|---|---|---|
| 1,417,427 | 5/1922 | Tracy | 219/367 |
| 1,531,518 | 3/1925 | Simmons | 219/365 |
| 1,651,890 | 12/1927 | Hicks | 219/368 UX |
| 1,705,812 | 3/1929 | Fisher | 219/365 UX |
| 1,875,752 | 9/1932 | Montero | 219/361 |
| 2,379,705 | 7/1945 | Graves | 219/370 |
| 2,391,207 | 12/1945 | Van Schaack | 219/367 |
| 2,863,980 | 12/1958 | Logan | 219/367 |
| 2,888,007 | 5/1959 | Tabor | 126/270 |
| 2,919,338 | 12/1959 | Covault et al. | 219/365 |
| 3,180,972 | 4/1965 | Covault | 219/365 |

FOREIGN PATENT DOCUMENTS

| | | | |
|---|---|---|---|
| 919040 | 10/1954 | Fed. Rep. of Germany | 219/349 |

*Primary Examiner*—A. Bartis

*Attorney, Agent, or Firm*—Lowe, Kokjer, Kircher, Wharton & Bowman

[57] ABSTRACT

A modular infrared space heating device includes an enclosure having an air inlet and an air exhaust. A plurality of open-ended ferrous metal conduits are positioned in the enclosure between the air exhaust and a plurality of infrared lamps. The conduits are supported at only one end on a ferrous metal sheet. Refractive lens means comprising a glass plate having a plurality of convex focussing surfaces equal in number to the conduits is provided between the lamps and the conduits and arranged so that each convex surface focusses infrared radiation from the lamps on a different one of the conduits. A fan is provided in the enclosure for circulating air through the enclosure from the air inlet, over the lamps, through and around the conduits and out the air exhaust.

10 Claims, 9 Drawing Figures

MODULAR INFRARED SPACE HEATER DEVICE

BACKGROUND OF THE INVENTION AND OBJECTS

Infrared heaters have been known for years but a continuing problem therewith has been the inefficiency thereof. The prior art includes U.S. Pat. No. 3,180,972 issued to D. W. Covault which depicts an end table heater including a fan, lamps, plate and conductor rods over which air is circulated. U.S. Pat. No. 3,575,582 shows an electric furnace with lamps, fan asembly, metal cylinder housed in cabinet structure wherein air is circulated by fan through and around cylinder to absorb heat generated by lamps and concentrated in the galvanized metal unit to provide heated air which exits through grills at the top of heating device. Other items of the prior art include the following U.S. Pat. Nos. 2,520,830 issued to Borzner; 2,938,101 issued to Borzner; 3,104,307 issued to Garofalow et al; 1,534,571 issued to Conning; 2,527,013 issued to Kjelgaard; 2,919,338 issued to Covault et al; 1,694,351 issued to Long; and 2,888,007 issued to Tabor and showing solar radiation admitting windows. The present invention is designed to improve the efficiency over any of the above noted systems.

An object of the present invention is to provide an unique and highly efficient electric heater.

A further object of the present invention is to provide a simple but highly efficient infrared space heater.

A further object of the present invention is to provide an electric heater wherein air is circulated over and around lamps and over and through ferrous conduits.

A further object of the present invention is to provide an electric space heater having an enclosure with infrared lamps, reflector, fan, refractive lens and ferrous metal conduits enclosed therein, with air being circulated through said enclosure by said fan.

A further object of this invention is to provide a modular electric space heater having an enclosure with a fan, infrared lamps, reflector, a refractive lens, ferrous conduits in proximity to said lens, with air being drawn into the enclosure by the fan and circulated past the lamps around the lens and through and around the conduits and exhausted from the enclosure as heated air, with said enclosure adaptable for mounting in furniture pieces such as end tables, occasional tables and other household furniture.

A further object of this invention is to provide a modular space heater providing a path for circulating air therethrough which maximizes the heat transfer to the circulating air.

A further object of this invention is to provide a modular infrared space heater providing a path for circulating air therethrough which maximizes the heat transfer to the circulating air.

A further object of this invention is to provide an infrared space heater which employs a fan, infrared lamps, refractive lens and ferrous conduits which may be employed in housings capable of being stacked one on top of the other to provide additional heating.

DETAILED DESCRIPTION

Figure 1:
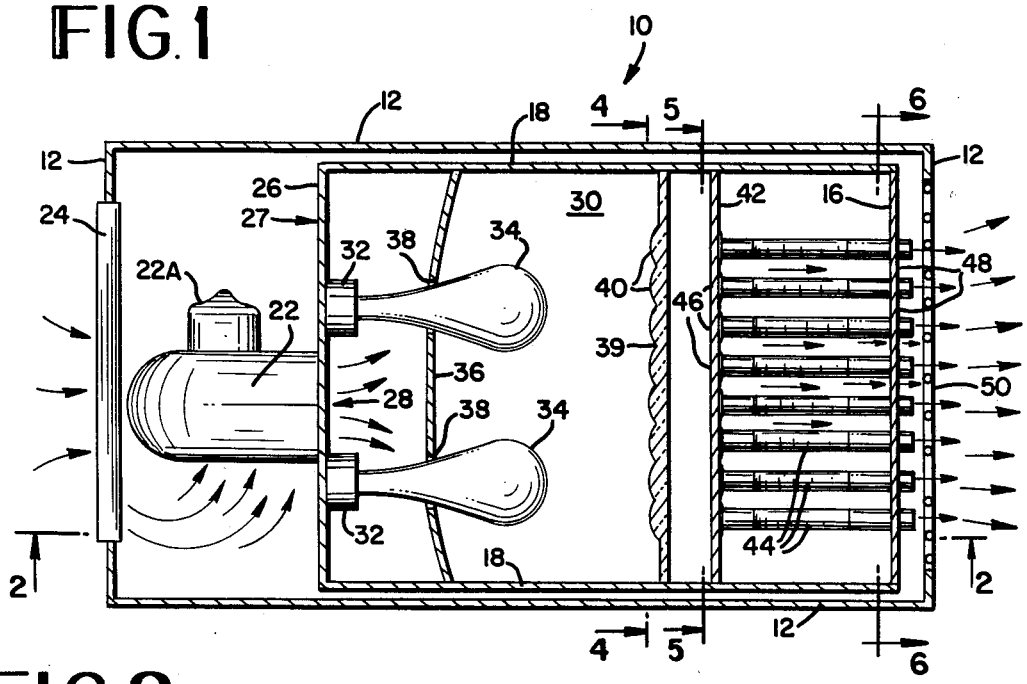
FIG. 1 is a horizontal sectional view along line 1—1 of FIG. 2 of the subject modular heating device.
Figure 2:
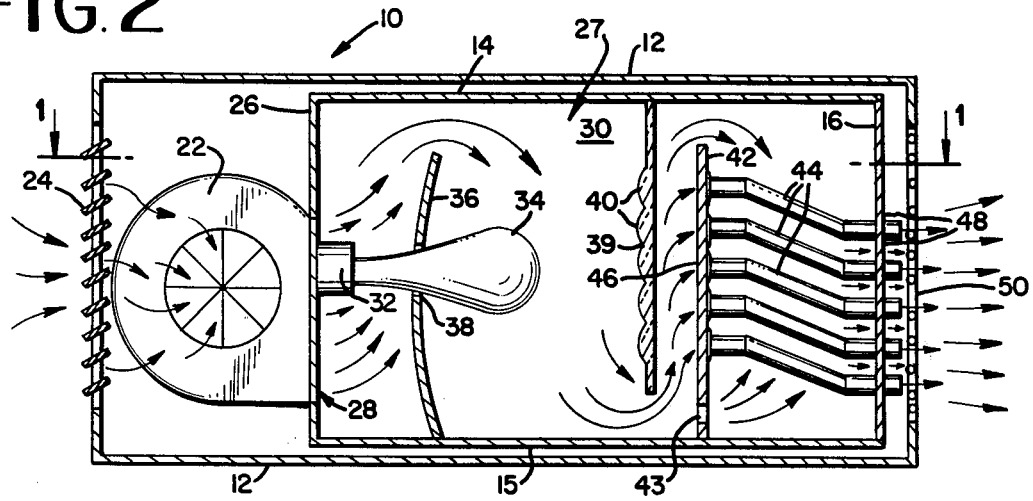
FIG. 2 is a vertical sectional view taken along the lines of 2—2 in FIG. 1.

Referring to the drawings wherein like numerals refer to like parts throughout, numeral 10 generally refers to the modular heating system of the invention. The heating system is enclosed in a metal rectangular solid shaped housing 12 as shown in perspective in FIG. 3 and which by way of example and not of limitation may be one foot in height, two feet in length and fifteen inches in width. The size of housing 12 may, of course, be increased or decreased without departing from the spirit or concept of the invention. Housing 12 has located therewithin at one end as shown in FIGS. 1 and 2 an electric motor-driven enclosed fan 22 of the squirrel cage variety commercially available such as manufactured by Fasco Industries of Ozark, Missouri, or Emerson Electric Company of St. Louis, Missouri. Typically the electric motor 22A of the fan unit will be of the fractional horsepower variety and the fan will have a capacity in the range of 120 C.F.M. Fan unit 22 is located between one end of housing 12 and metal sheet 26 as seen in FIGS. 1 and 2. Sheet 26 is one end of a rectangular-box-shaped enclosure 27 forming a heating chamber 30 which has top 14, bottom 15, sides 18 and opposite end 16; the enclosure 27 being fully within outer housing 12 and being suspended with at least one inch clearance on all sides from housing 12 for safety purposes. The heating chamber 30 formed by enclosure 27 is suspended relative to outer housing 12 by struts therebetween (not shown). Fan unit 22 is mounted on metal sheet 26 in such manner that it exhausts through opening 28 in 26 into heating chamber 30. In heating chamber 30, there are located electric lamp sockets or holders 32 which are mounted on sheet 26 on either side of opening 28. Lamp sockets 32 are of the commercially available variety having a threaded interior to facilitate reception of the threaded bases of infrared lamps 34. Lamps 34 are commercially available from the Sylvania, General Electric or Westinghouse companies and are preferably of 250 or 375 wattage although other wattage lamps could be used without departing from the scope of this invention. Positioned across heating chamber 30 is reflector 36 in such manner that it is in continuous contact with bottom 15 and sides 18 of the chamber 30 but is separated from top 14 as seen in FIG. 2, to allow air to pass thereover. Reflector 36 has openings therethrough at 38 through which lamps 34 are inserted preparatory to insertion into lamp holders 32.

Figure 4:
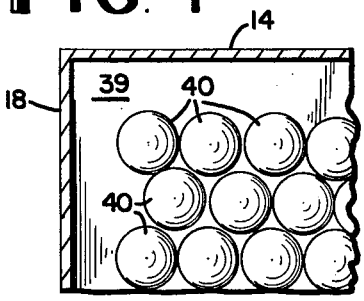
FIG. 4 is an enlarged portion of a sectional view along the lines of 4—4 in FIG. 1.

As seen in FIGS. 1 and 2, a heat-tempered refracting lens generally referred to as 39 is positioned in continuous contact with and in perpendicular relationship to sides 18 and top 14 of heat chamber 30. Lens 39 is positioned in spaced relationship to heat chamber bottom 15 as seen in FIG. 2 to permit air passage thereunder. As best seen in FIG. 4, lens 39 has series of circular bubble or convex shaped surfaces 40 projecting toward lamps 34. Lens 39 is, as noted above, a heat-tempered refracting lens made of commercially available glass and by way of example and not of limitation may be made from Corning Glass No. 7760. Lens 39 serves to concentrate infrared radiation from lamps 34 on ferrous sheet 42 and ferrous conduits 44 hereinafter described.

Figure 5:
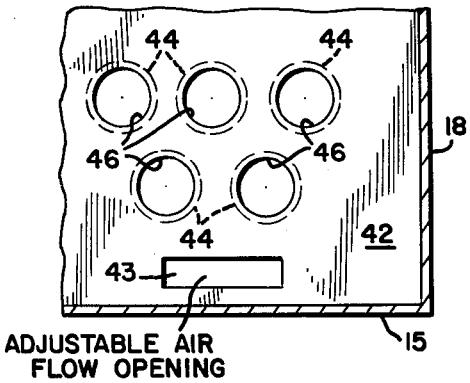
FIG. 5 is an enlarged portion of a sectional view along the lines of 5—5 in FIG. 1.

Positioned in continuous contact with and in perpendicular relationship to sides 18 and bottom 15 is ferrous metal sheet 42 which is mounted in a spaced apart relationship to top 14 to permit air passage thereover. Welded or otherwise solely mounted on and in perpendicular relationship to sheet 42 are series of ferrous metal conduits 44. The number of conduits 44 is matched to the number of "bubbles" 40 in lens 39 and aligned therewith such that the radiation transmitted through each "bubble" in lens 39 is concentrated on the closest end of its associated conduit 44. Sheet 42 contains round fenestrations 46 as shown in FIG. 5 equal in number to the number of "bubbles" 40 in lens 39 and equal to the number of conduits 44. Each fenestration registers on one side of sheet 42 with the opening of the associated conduit 44. Thus, each conduit is welded or otherwise attached at one end around the periphery of its associated fenestration in such manner at to channel air passing through the fenestrations 46 of sheet 42 directly into the associated conduits 44.

Figure 6:
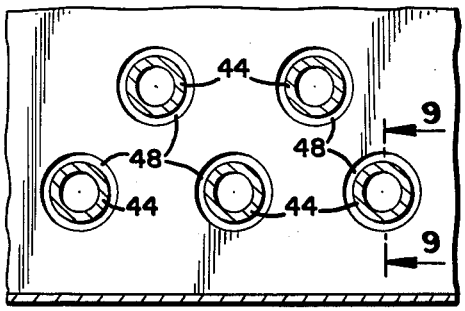
FIG. 6 is an enlarged portion of a sectional view taken along the lines of 6—6 in FIG. 1.
Figure 7:
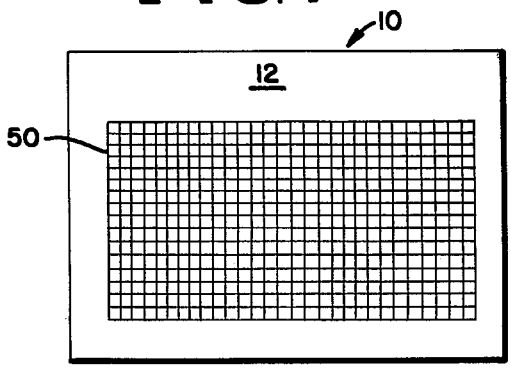
FIG. 7 is a view of the exhaust end of the modular heater.
Figure 9:
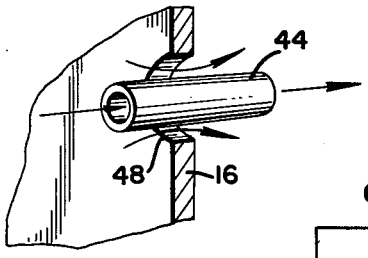
FIG. 9 is a portion of a sectional view taken along 9—9 in FIG. 6.

The unsupported ends of conduits 44 extend through fenestrations 48 as shown in FIG. 6 in sheet 16 to exhaust just short of a screen 50 in the end wall of housing 12. The fenestrations 48 in 16 are somewhat larger than the outside diameter of the conduits 44; thus the conduits 44 extend therethrough without touching 16 and with sufficient clearance to allow air to pass through the fenestrations 48 in sheet 16 around the outside of conduits 44. Conduits 44 are shown as angled to increase the heat exchange surface area over which and through which air flows but, of course, conduits 44 could be straight or otherwise increased in length if desired.

Figure 3:
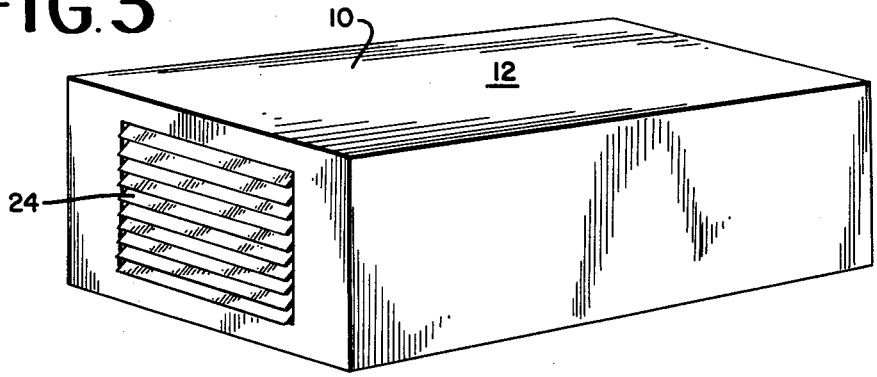
FIG. 3 is a perspective view of the subject modular heating device.

Adjacent fan unit 22 is a louvered opening 24 as seen in FIG. 3 through which air is drawn in as seen in FIGS. 1 and 2.

Figure 8:
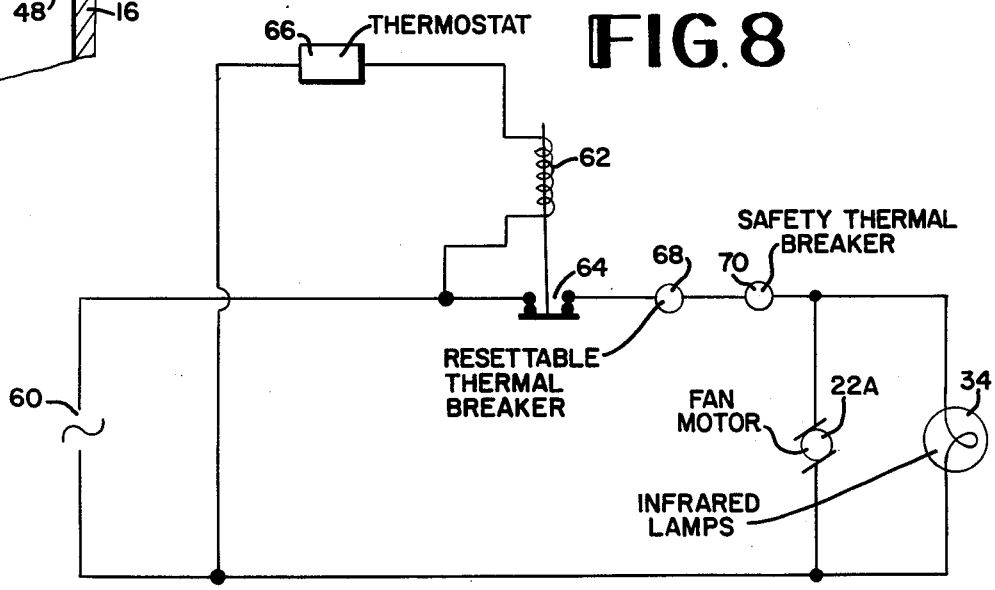
FIG. 8 is a diagram of the circuit employed with the modular heater.

The circuit diagram for the invention is seen in FIG. 8 wherein a conventional a.c. source 60 is series connected to a conventional thermostat 66 and relay coil 62 having associated contacts 64. Connected across source 60 when contacts 64 are closed are fan motor 22*a* and lamps 34. Series connected to the parallel combination of lamps and fan motor are one commercially available 140° F. resettable breaker 68 such as Model L 140-2 of Texas Instruments and one one time burn out 160° F. breaker 70 such as that manufactured by Minnesota Mining and Manufacturing Company, Model RD 070-002.

The voltage requirements of thermostat 66 may be provided by a step down transformer not shown from source 60 or by another power supply.

Since housings 12 are designed to be stacked one on the other while in operation to facilitate greater heating capacity when required, there is provided an opening (not shown) in 12 and one of the sides 18 to facilitate replacement of lamps 34.

Obviously the size of the unit may be varied to include more or less lamps, fans, lenses and conduits without departing from the scope of this invention.

The size of the conduits can, of course, vary but in practice ferrous conduits of the quarter inch size have been found satisfactory. While as elsewhere herein noted, conduits 44 are shown as angled, they could be looped, formed in a coil fashion or angled as a series of W's to increase heat transfer surface area and yet be within the scope of this invention.

Housing 12 may be altered in shape as, for example, it may be cylindrical in shape or in the shape of a cube and may be mounted within furniture pieces such as in end tables, occasional tables, within chests of drawers or any other furniture piece large enough to accommodate the physical and thermal requirements. Further, of course, the housing 12 may be mounted in walls, ceilings or floors provided adequate air flow and insulation requirements are met.

The foregoing is considered as illustrative only of the principles of the invention. Modifications other than those noted herein will be apparent to those skilled in the art; thus it is not desired to limit the invention to the exact construction and/or operation shown in the figures and described in this specification. Rather, all equivalents and modifications that may be resorted to fall within the scope of the claimed invention.

OPERATION

When thermostatic switch 66 closes upon the temperature at the situs of employment dropping to a predetermined temperature, coil 62 is energized closing contacts 64. Upon closure of the latter, lamps 34 are energized and fan motor 22*a* is energized. Fan unit 22, upon energization, draws air through louvered intake 24 into housing 12. Air then is drawn into the axial intake of 22 as shown by arrows in FIG. 1 and is exhausted through opening 28 into heating chamber 30. In chamber 30 the air is circulated up past the bases and necks of lamps 34 and over the top of reflector 36 as seen in FIG. 2. The air is then circulated down over the bulb ends of lamps 34 then under lens 39 toward ferrous metal sheet 42. A portion of the air then goes through the fenestrations 46 of sheet 42 and enters conduits 44. Some air is circulated over the top of sheet 42 (between the top edge of sheet 42 and top 14) and some air may be allowed to enter the space between 42 and 16 through an adjustable opening 43 in 42 near bottom 15 to regulate air flowing over the outsides of conduits 44 and through fenestrations 48 in 16. The air is heated as it passes through and over conduits 44 and is exhausted through screen 50 in housing 12 to the room in which the unit is employed. When the room temperature rises sufficiently to open thermostat 66, thus deenergizing relay 62 and opening contacts 64, the lamps 34 and fan motor 22*a* will be deenergized. The process would then be repeated as room temperature lowers where the unit is employed. The refractive lens 39 serves to maximize heating of the air in chamber 30 by concentrating the infrared rays of lamps 34 on sheet 42 and the ends of conduits 44 closest to lens 39. As the infrared field heats the ferrous conduits and sheet 42, the air circulated thereover absorbs the heat and carries it through duct 50 into the room. Of course, the circulating air will absorb some heat from ferrous sheets 26, 18, 15, 14 and 16 in addition to that from 42 and 44.

I claim as my invention the following:

1. An infrared heater comprising:

an enclosure means having an air inlet and and air exhaust;

infrared radiation source means positioned within said enclosure means;

a plurality of open-ended ferrous metal conduits positioned within said enclosure means between said infrared radiation source means and said air exhaust and in proximity to said infrared radiation source to be irradiated thereby, said metal conduits being mounted on a ferrous metal sheet at one end of said conduits and being otherwise unsupported;

refractive lens means positioned within said enclosure means between said infrared radiation source means and said metal conduits, said refractive lens means being a glass plate having a plurality of convex surfaces, each associated with a different metal conduit such that the center of each convex surface is aligned with the axial center of its associated metal conduit to thereby concentrate radiation from the infrared source means onto its associated metal conduit; and fan means for circulating air through said enclosure means from said air inlet to said air exhaust such that the air circulating through said enclosure means flows through and around said metal conduits to absorb heat therefrom.

2. The infrared heater as in claim 1 wherein said metal conduits are constructed to have a round cross section.

3. The infrared heater as in claim 1 wherein said infrared radiation source means is comprised of at least one infrared lamp.

4. The infrared heater as in claim 1 wherein the other end of said metal conduits extend from inside said enclosure means to outside of the walls of said enclosure means through said air exhaust without being in direct contact with said enclosure means.

5. The infrared heater as in claim 1 wherein said ferrous metal sheet has fenestrations defined therein, said sheet being positioned between said refractive lens means and said metal conduits, with said metal conduits each having said one end thereof mounted to said sheet with said mounted end of each of said conduits registering with one of said fenestrations in said sheet.

6. An infrared heater comprising:

enclosure means having an air inlet and and air exhaust;

infrared radiation source means positioned within said enclosure means;

a plurality of open-ended ferrous metal conduits positioned within said enclosure means between said infrared radiation source means and said air exhaust and in proximity to said infrared radiation source means to be irradiated thereby, said metal conduits being mounted on a ferrous metal sheet at one end of said metal conduits and being otherwise unsupported;

refractive lens means positioned within said enclosure means between said infrared radiation source means and said metal conduits, said refractive lens means being a glass plate having a plurality of convex surfaces on the surface thereof facing said infrared radiation source means for concentrating radiation from said infrared radiation source means onto said metal conduits;

said metal conduits and said convex surfaces being equal in number and positioned such that the center of each convex surface is associated and aligned with the axis line of the end of a different one of said metal conduits whereby the radiation from said infrared radiation source means passing through an individual one of said convex surfaces is directed upon an associated one of said metal conduits; and fan means for circulating air through said enclosure means from said air inlet to said air exhaust such that the air circulating through said enclosure means flows through and around said metal conduits to absorb heat therefrom.

7. The infrared heater as in claim 6 wherein said metal conduits are constructed to have a round cross section.

8. The infrared heater as in claim 6 wherein said infrared radiation source means is comprised of at least one infrared lamp.

9. The infrared heater as in claim 6 wherein the other end of said metal conduits extend from inside said enclosure means to outside of the walls of said enclosure means through said air exhaust without being in direct contact with said enclosure means.

10. The infrared heater as in claim 6 wherein said ferrous metal sheet has fenestrations defined therein, said sheet being positioned between said refractive lens means and said metal conduits, with said metal conduits each having said one end thereof mounted to said sheet with said mounted end of each of said conduit registering with one of said fenestrations in said sheet.

* * * * *